US012203205B2

(12) United States Patent
Lee et al.

(10) Patent No.: US 12,203,205 B2
(45) Date of Patent: Jan. 21, 2025

(54) LAUNDRY TREATING APPARATUS

(71) Applicant: LG Electronics Inc., Seoul (KR)

(72) Inventors: Kilryong Lee, Seoul (KR); Bokyung Suh, Seoul (KR); Uikun Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 450 days.

(21) Appl. No.: 17/540,671

(22) Filed: Dec. 2, 2021

(65) Prior Publication Data

US 2022/0170195 A1 Jun. 2, 2022

(30) Foreign Application Priority Data

Dec. 2, 2020 (KR) ..... 10-2020-0166363

(51) Int. Cl.
*D06F 39/08* (2006.01)
*D06F 39/02* (2006.01)

(52) U.S. Cl.
CPC ..... *D06F 39/028* (2013.01); *D06F 39/083* (2013.01); *D06F 39/088* (2013.01)

(58) Field of Classification Search
CPC .... D06F 39/028; D06F 39/083; D06F 39/088; D06F 37/266; D06F 23/02; D06F 39/085; D06F 37/22; D06F 37/304; D06F 37/40; D06F 39/02
USPC ..... 68/12.01, 139
See application file for complete search history.

(56) References Cited

U.S. PATENT DOCUMENTS 5,375,438 A * 12/1994 Babuin ..... D06F 39/088 68/17 R
9,534,331 B2 * 1/2017 Im ..... D06F 37/266
11,028,519 B2 * 6/2021 Lee ..... D06F 39/083
11,208,756 B2 * 12/2021 Lee ..... D06F 39/088
11,859,333 B2 * 1/2024 Kim ..... D06F 37/266
11,866,879 B2 * 1/2024 Lee ..... D06F 39/088
2009/0249840 A1 * 10/2009 Jo ..... D06F 39/088 68/58

(Continued)

FOREIGN PATENT DOCUMENTS

KR 2020-0001526 1/2020
KR 2020-0095910 8/2020

OTHER PUBLICATIONS

Extended European Search Report in European Appln No. 21211543.0, dated Apr. 21, 2022, 13 pages.

*Primary Examiner* — Michael E Barr
*Assistant Examiner* — Thomas Bucci
(74) *Attorney, Agent, or Firm* — Fish & Richardson P.C.

(57) ABSTRACT

A laundry treating apparatus includes a cabinet, a tub, a drum having a drum opening in communication with a tub opening, a gasket for connecting a laundry inlet of the cabinet and the tub opening to each other, a pump for pumping water discharged from the tub to the tub, and a circulation portion that supplies water pumped by the pump into the tub and includes a circulation flow path portion for guiding water pumped by the pump to the gasket and a nozzle portion connected to the circulation flow path portion to spray water into the tub. The nozzle portion includes a nozzle spray portion coupled to the gasket to pass therethrough to spray water into the tub, and a nozzle coupling portion extending from the nozzle spray portion to be coupled to the tub. The nozzle coupling portion supports the nozzle spray portion.

14 Claims, 13 Drawing Sheets

(56) References Cited

U.S. PATENT DOCUMENTS

| | | | | |
|---|---|---|---|---|
| 2010/0205753 | A1* | 8/2010 | Kim | D06F 39/083 68/200 |
| 2011/0083477 | A1* | 4/2011 | Kim | D06F 37/266 68/140 |
| 2011/0265525 | A1* | 11/2011 | Gweon | D06F 39/088 68/200 |
| 2012/0017649 | A1* | 1/2012 | Kim | D06F 37/26 68/139 |
| 2014/0033449 | A1* | 2/2014 | Im | D06F 37/266 8/137 |
| 2014/0299164 | A1* | 10/2014 | Zhang | D06F 33/43 134/199 |
| 2014/0311189 | A1* | 10/2014 | Im | D06F 21/04 68/12.01 |
| 2014/0352363 | A1* | 12/2014 | Kim | D06F 37/266 239/600 |
| 2015/0082838 | A1* | 3/2015 | Gweon | D06F 39/083 68/139 |
| 2015/0121969 | A1* | 5/2015 | Lim | D06F 37/267 68/131 |
| 2017/0241060 | A1* | 8/2017 | Seong | D06F 39/14 |
| 2019/0112748 | A1* | 4/2019 | Lee | D06F 39/088 |
| 2019/0136438 | A1* | 5/2019 | Lee | D06F 37/266 |
| 2019/0203405 | A1* | 7/2019 | Lee | D06F 23/06 |
| 2019/0211495 | A1* | 7/2019 | Im | D06F 37/145 |
| 2019/0323162 | A1* | 10/2019 | Jung | D06F 37/30 |
| 2019/0330780 | A1* | 10/2019 | Jung | D06F 37/06 |
| 2020/0002879 | A1* | 1/2020 | Jang | D06F 37/04 |
| 2020/0002880 | A1* | 1/2020 | Choi | D06F 39/088 |
| 2020/0248371 | A1* | 8/2020 | Lee | D06F 37/266 |
| 2020/0248381 | A1* | 8/2020 | Lee | D06F 39/088 |

* cited by examiner

LAUNDRY TREATING APPARATUS

CROSS-REFERENCE TO RELATED APPLICATIONS

This application claims the benefit of Korean Patent Application No. 10-2020-0166363, filed on Dec. 2, 2020, which is hereby incorporated by reference as if fully set forth herein.

TECHNICAL FIELD

The present disclosure relates to a laundry treating apparatus. More specifically, the present disclosure relates to a laundry treating apparatus in which, among components of a circulation portion that discharges water stored in a tub of the laundry treating apparatus to the outside of the tub and then supplies the water back into the tub, a nozzle portion that sprays circulating water into the tub is easily coupled to a gasket and is commonly disposed on left and right sides to be applicable to various models.

BACKGROUND

In general, a laundry treating apparatus is an apparatus capable of performing washing, drying, or the washing and the drying of laundry and the like. In this connection, the laundry treating apparatus may perform only the washing or the drying, or both the washing and the drying. In addition, in recent years, a washing machine including a steam supply to have a refresh function such as wrinkle removal, odor removal, static electricity removal, and the like of the laundry is being distributed.

In one example, conventional laundry treating apparatuses are classified into a front load type and a top load type based on a direction of withdrawal of the laundry. A representative example of such a horizontal type is a drum washing machine or a drum dryer.

The front load type laundry treating apparatus refers to a laundry treating apparatus that has an opening defined in a front surface thereof, and has a rotation shaft of a drum parallel to or having a certain inclination to the ground. The top load type laundry treating apparatus refers to a laundry treating apparatus that has the opening defined in a top surface thereof, and has the rotation shaft of the drum perpendicular to the ground.

Korean Patent Application Publication No. 10-2020-0001526 discloses a washing machine having a nozzle that sprays circulating water pumped by a pump into the drum. The washing machine includes a plurality of nozzles disposed on an inner circumferential surface of a gasket body to spray wash water into the drum, and includes a distribution tube having a plurality of discharge ports respectively coupled to the plurality of nozzles.

The distribution tube defines an annular flow path to supply the water supplied from the pump back into the drum. Because the distribution tube is formed in an annular shape, when coupling the distribution tube to a gasket, the plurality of discharge ports must be simultaneously coupled to the corresponding nozzles by a strong elasticity of the gasket.

In addition, when sizes of a tub and the gasket are changed, the annular distribution tube must be newly manufactured based on the corresponding sizes. Accordingly, in a mass production process, a distribution tube applied to one laundry treating apparatus model may not be applied to another laundry treating apparatus model.

SUMMARY

Embodiments of the present disclosure are to provide a laundry treating apparatus including a nozzle portion for circulating water spray that is commonly applicable in a plurality of laundry treating apparatuses having various sizes and internal structures.

Embodiments of the present disclosure are to provide a laundry treating apparatus including a nozzle portion for circulating water spray or a circulation flow path portion applicable even when a space between a tub and a cabinet is narrow.

Embodiments of the present disclosure are to provide a laundry treating apparatus including a nozzle portion having a structure that facilitates installation on a gasket.

Embodiments of the present disclosure are to provide a laundry treating apparatus including a circulating water branch connector that is commonly applicable in a plurality of laundry treating apparatuses having various sizes and internal structures, and branches water supplied from a pump.

In addition, embodiments of the present disclosure are to provide a laundry treating apparatus including a nozzle portion applicable to both sides without distinction of the nozzle portions on both left and right sides.

In addition, embodiments of the present disclosure are to provide a laundry treating apparatus that may subdivide and miniaturize parts constituting a circulation portion that supplies circulating water into several parts.

In addition, embodiments of the present disclosure are to provide a laundry treating apparatus including a nozzle portion that is easy to be coupled to and separated from a gasket, and is easy to be replaced.

In addition, embodiments of the present disclosure are to provide a laundry treating apparatus including a nozzle portion that more stably couples a nozzle portion that sprays circulating water and is not decoupled even during circulating water spray.

Embodiments of the present disclosure may improve manufacturing easiness and maintenance convenience by miniaturizing and generalizing parts constituting a circulation portion of a laundry treating apparatus.

Embodiments of the present disclosure may install a circulation portion even when a space between a tub and a cabinet is narrow using a nozzle portion that may be miniaturized and a branch flow path that is constructed as a hose to supply water to the nozzle portion instead of an integrally formed annular flow path.

An aspect of the present disclosure provides a laundry treating apparatus including a cabinet having a laundry inlet defined therein, a tub disposed inside the cabinet to provide therein a space for storing water, wherein the tub has a tub opening in communication with the laundry inlet, a drum rotatably disposed inside the tub to provide therein a space for accommodating laundry, wherein the drum has a drum opening in communication with the tub opening, a detergent supply disposed inside the cabinet to provide therein a space for storing detergent, a gasket for connecting the laundry inlet and the tub opening to each other, a pump for pumping water discharged from the tub to the tub, and a circulation portion for supplying water pumped by the pump into the tub, the circulation portion includes a circulation flow path portion for guiding water pumped by the pump to the gasket, and a nozzle portion connected to the circulation flow path portion to spray water into the tub, and the nozzle portion includes a nozzle spray portion coupled to the gasket to pass therethrough to spray water into the tub, and a nozzle coupling portion extending from the nozzle spray portion to be coupled to the tub, wherein the nozzle coupling portion supports the nozzle spray portion.

In one implementation, the gasket may include a gasket body for connecting the laundry inlet and the tub opening to each other, and a gasket guide protruding from an outer circumferential surface of the gasket body to communicate an inner circumferential surface and the outer circumferential surface of the gasket body to each other, and the nozzle spray portion may be inserted into the gasket guide.

In one implementation, the nozzle spray portion may include a nozzle pipe connected to the circulation flow path portion and having a nozzle flow path defined therein, and a discharge pipe extending from the nozzle pipe and inserted into the gasket guide, wherein the discharge pipe has a spray flow path defined therein in communication with the nozzle flow path.

In one implementation, the discharge pipe may include a first discharge pipe and a second discharge pipe spaced apart from each other, and the first discharge pipe and the second discharge pipe may independently extend from the nozzle pipe to be in parallel with each other.

In one implementation, the nozzle portion may further include a pipe protruding portion extending from a free end of the discharge pipe to be away from the nozzle pipe, wherein the pipe protruding portion has an outer diameter increasing or decreasing along an extending direction, and the pipe protruding portion may be inserted into the gasket guide.

In one implementation, the circulation flow path portion may include a supply pipe connected to the pump, a branch connector connected to the supply pipe to branch water supplied from the supply pipe, and branch flow paths connected to the branch connector to guide water branched by the branch connector to both sides of the tub opening, and the nozzle portions may be connected to the branch flow paths on the both sides of the tub opening, respectively.

In one implementation, the branch connector may include a water supply pipe connected to the supply pipe, drain pipes extending in different directions from the water supply pipe and coupled to the branch flow paths, and a connector coupling portion extending from the supply pipe or the water supply pipe and coupled to the tub.

In one implementation, the tub may further include a connector boss protruding toward the connector coupling portion and coupled to the connector coupling portion.

In one implementation, the circulation flow path portion may guide water pumped by the pump by branching water to both sides of the tub opening, the nozzle portions may be connected to the circulation flow path portion on the both sides of the tub opening, respectively, and the nozzle coupling portion may be coupled to the tub such that one surface thereof is in contact with the tub on one side of the tub opening and the other surface thereof is in contact with the tub on the other side of the tub opening.

In one implementation, the nozzle coupling portion may include a first coupling portion extending from the nozzle spray portion and coupled to the tub, and a second coupling portion extending from the first coupling portion and coupled to the tub, and the first coupling portion may be coupled to the tub on said one side of the tub opening and the second coupling portion may be coupled to the tub on the other side of the tub opening.

In one implementation, the laundry treating apparatus may further include an extension coupling portion for connecting the first coupling portion and the second coupling portion to each other, and the extension coupling portion may connect the first coupling portion and the second coupling portion to each other in a stepped manner with respect to the tub.

In one implementation, the tub may further include a first nozzle boss protruding from said one side of the tub opening to be coupled to the first coupling portion, and a second nozzle boss protruding from the other side of the tub opening to be coupled to the second coupling portion, and the first nozzle boss and the second nozzle boss may have different distances spaced from a bottom surface of the cabinet.

In one implementation, the first coupling portion may include a first coupling guide for guiding the coupling of the nozzle spray portion to the gasket at said one side of the tub opening, and a first coupling hole coupled to the first nozzle boss at said one side of the tub opening, and the second coupling portion may include a second coupling guide for guiding the coupling of the nozzle spray portion to the gasket at the other side of the tub opening, and a second coupling hole coupled to the second nozzle boss at the other side of the tub opening.

In one implementation, the laundry treating apparatus may further include a guide tube having one end coupled to the detergent supply, and the other end coupled to the gasket to supply detergent stored in the detergent supply into the tub.

Another aspect of the present disclosure provides a laundry treating apparatus including a cabinet having a laundry inlet defined therein, a tub fixed inside the cabinet and having a tub opening defined therein in communication with the laundry inlet, a drum rotatably disposed inside the tub and having a drum opening defined therein in communication with the tub opening, a driver including a bearing housing for rotatably supporting a rotation shaft connected to the drum, and a driving motor for rotating the rotation shaft, a suspension connected to the bearing housing and buffering vibration of the drum, a gasket for connecting the laundry inlet and the tub opening to each other, a pump for pumping water discharged from the tub to the tub, and a circulation portion for supplying water pumped by the pump into the tub, the circulation portion includes a circulation flow path portion for guiding water pumped by the pump by branching water to both sides of the tub opening, and a nozzle portion including a nozzle spray portion coupled to the gasket from each of the both sides of the tub opening to spray water into the tub, and the nozzle spray portion is disposed such that one surface thereof faces the tub on one side of the tub opening and the other surface thereof faces the tub on the other side of the tub opening.

In one implementation, the gasket may include a gasket body for connecting the laundry inlet and the tub opening to each other, and a gasket guide protruding from an outer circumferential surface of the gasket body to communicate an inner circumferential surface and the outer circumferential surface of the gasket body to each other, and the nozzle spray portion may be coupled to the gasket guide.

In one implementation, the tub may include a tub rim protruding forward from a circumference of the tub opening, and the gasket guide may be coupled to the tub rim by penetrating the tub rim.

In one implementation, the nozzle spray portion may include a first nozzle connected to the circulation flow path portion and the gasket guide, wherein the first nozzle has an open flow path defined therein at one side thereof, a second nozzle connected to the gasket guide, and a spray connection flow path for connecting the first nozzle and the second nozzle to each other.

In one implementation, the tub may include a front tub constituting a front portion of the tub and having the tub opening defined therein, a rear tub constituting a rear portion of the tub and having an opening defined in a rear surface thereof, and a back tub accommodated inside the opening, wherein the back tub is penetrated by the rotation shaft.

In one implementation, the laundry treating apparatus may further include a rear gasket for sealing a space between the rear tub and the back tub and allowing the driver to move relative to the rear tub.

Embodiments of the present disclosure may provide the laundry treating apparatus including the nozzle portion for the circulating water spray that is commonly applicable in the plurality of laundry treating apparatuses having the various sizes and the internal structures.

Embodiments of the present disclosure may provide the laundry treating apparatus including the nozzle portion for the circulating water spray or the circulation flow path portion applicable even when the space between the tub and the cabinet is narrow.

Embodiments of the present disclosure are to provide the laundry treating apparatus including the nozzle portion having the structure that facilitates the installation on the gasket.

Embodiments of the present disclosure may provide the laundry treating apparatus including the circulating water branch connector that is commonly applicable in the plurality of laundry treating apparatuses having the various sizes and the internal structures, and branches the water supplied from the pump.

In addition, embodiments of the present disclosure may provide the laundry treating apparatus including the nozzle portion applicable to the both sides without the distinction of the nozzle portions on both the left and right sides.

In addition, embodiments of the present disclosure may provide the laundry treating apparatus that may subdivide and miniaturize the parts constituting the circulation portion that supplies the circulating water into the several parts.

In addition, embodiments of the present disclosure may provide the laundry treating apparatus including the nozzle portion that is easy to be coupled to and separated from the gasket, and is easy to be replaced.

In addition, embodiments of the present disclosure may provide the laundry treating apparatus including the nozzle portion that more stably couples the nozzle portion that sprays the circulating water and is not decoupled even during the circulating water spray.

DETAILED DESCRIPTION

Figure 1:
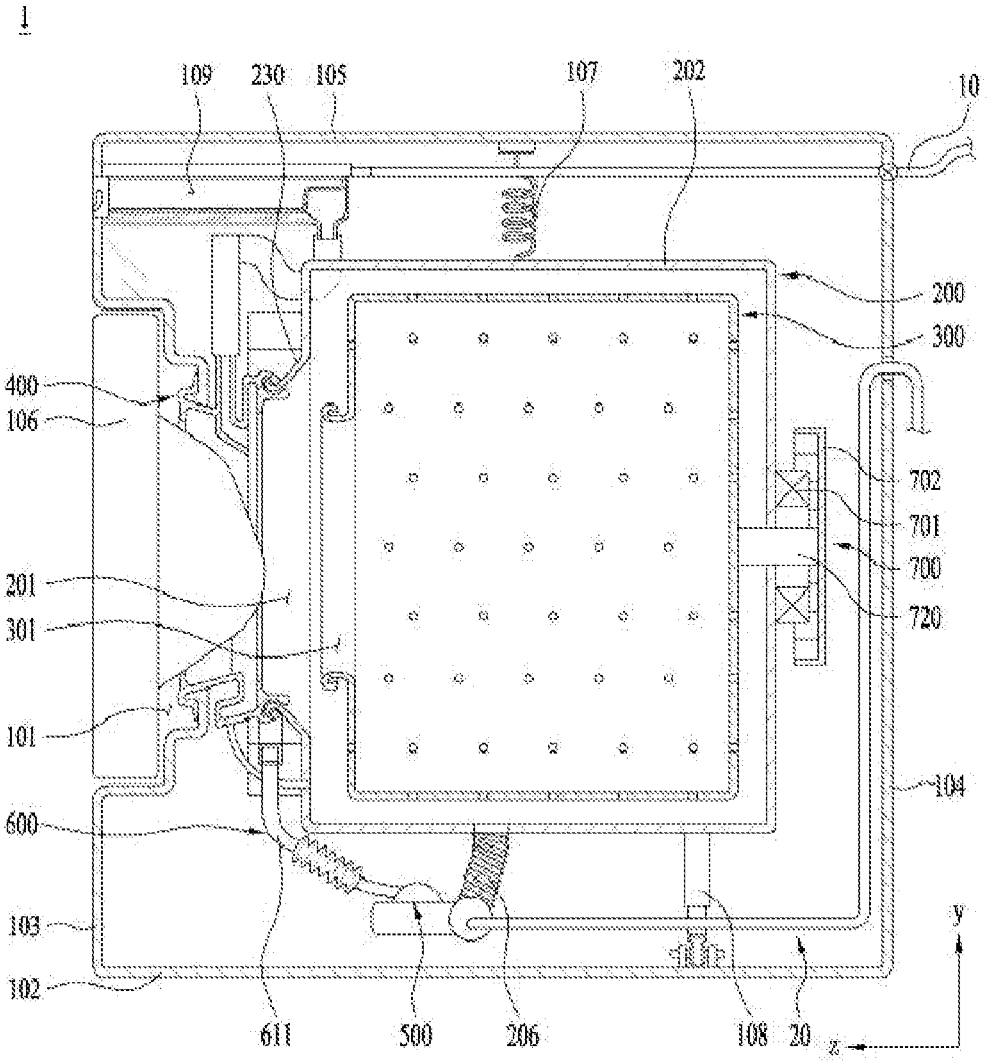
FIG. 1 is a cross-sectional view showing a laundry treating apparatus according to an embodiment of the present disclosure.

Hereinafter, with reference to the accompanying drawings, the present disclosure will be described in detail to be easily implemented by a person with ordinary skill in the technical field to which the present disclosure belongs.

However, the present disclosure is able to be implemented in several different forms and is not limited to the embodiment described herein. In addition, in order to clearly illustrate the present disclosure in the drawings, portions irrelevant to the description are omitted, and similar reference numerals are assigned to similar portions throughout the specification.

In the present specification, duplicate descriptions of the same components will be omitted.

In addition, it should be understood that when a component is referred to as being 'connected to' or 'coupled to' another component herein, it may be directly connected to or coupled to the other component, or one or more intervening components may be present. On the other hand, it should be understood that when a component is referred to as being 'directly connected to' or 'directly coupled to' another component herein, there are no other intervening components.

In addition, the terminology used in the present specification is only used to describe a specific embodiment, and is not intended to limit the present disclosure.

In addition, in the present specification, the singular expression may include the plural expression unless the context clearly dictates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in the present specification, the term 'and/or' includes a combination of a plurality of listed items or any of the plurality of listed items. In the present specification, 'A or B' may include 'A', 'B', or 'both A and B'.

Figure 2:
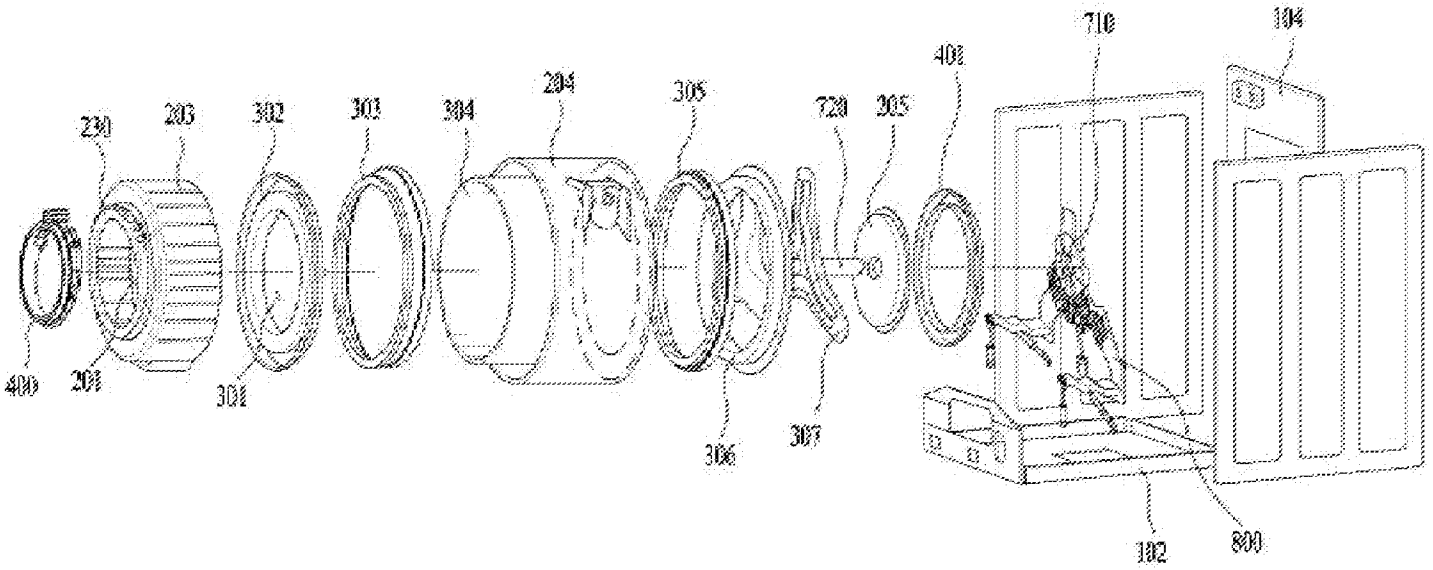
FIG. 2 is an exploded perspective view showing a laundry treating apparatus according to an embodiment of the present disclosure.

FIG. 1 is a cross-sectional view showing a laundry treating apparatus 1 according to an embodiment of the present disclosure, and FIG. 2 is an exploded perspective view showing the laundry treating apparatus 1 according to another embodiment of the present disclosure.

The present disclosure laundry treating apparatus 1 includes a cabinet 100 having a laundry inlet 101 defined therein, a tub 200 disposed inside the cabinet to provide therein a space for storing water, and having a tub opening 201 in communication with the laundry inlet 101, and a drum 300 rotatably disposed inside the tub 200 to provide therein a space for accommodating laundry, and having a drum opening 301 in communication with the tub opening 201.

The cabinet 100 may include a base 102 that forms a bottom surface of the laundry treating apparatus 1, a front panel 103 that forms a front surface of the laundry treating apparatus, a rear panel 104 that forms a rear surface of the laundry treating apparatus, a first side panel (not shown) and a second side panel (not shown) that form side surfaces of the laundry treating apparatus 1, and a top panel 105 that forms a top surface of the laundry treating apparatus. The front panel 103 and the rear panel 104 may be fixed to the base 102, and the first side panel and the second side panel may be fixed to the base 102 to connect the front panel 103 and the rear panel 104 to each other.

The front panel 103 has the laundry inlet 101 defined therein for communicating an interior and an exterior of the cabinet 100. The laundry inlet 101 may be opened and closed by a door 106 pivotably disposed on the front panel 103.

The tub 200 may be constructed as a cylindrical tub body 202 with an empty interior. The tub opening 201 is defined in a front surface of the tub body. The tub opening 201 is connected to the laundry inlet 101 through a gasket 400. A specific structure of the gasket 400 will be described later.

The tub body 202 may be fixed inside the cabinet 100 through a tub support. The tub support may be constructed as a spring 107 that fixes a region located above a horizontal line passing through a center of rotation of the drum 300 of a circumferential surface of the tub body 202 to the cabinet 100, and a damper 108 that fixes a region located below the horizontal line of the circumferential surface of the tub body 202 to the cabinet 100.

The damper 108 may be constructed to include a first damper located on a left side of a vertical line V passing through the center of rotation of the drum of the circumferential surface of the tub body 202, and a second damper located on a right side of the vertical line.

A front load portion for increasing a weight of the tub body 202 may be further disposed on the front surface of the tub body 202. When the weight of the tub body 202 is increased through the front load portion, the tub body 202 may absorb a stronger vibration, so that the present disclosure may minimize transmission of a vibration generated when the drum 300 is rotated to the cabinet.

As shown in FIG. 1, the drum 300 is accommodated inside the tub body 202. The drum opening 301 is defined in the front surface of the drum 300, that is, one surface of the drum 300 facing the tub opening 201. The drum opening 301 may be in communication with the tub opening 201 to allow a user to accommodate the laundry in the drum 300 through the tub opening 201 through the laundry inlet 101.

The drum 300 is rotated by a driver 700. The driver 700 may include a stator 701 fixed to a rear surface of the tub body 202 to generate a rotating magnetic field, a rotor 702 positioned outside the tub body 202 to rotate by the rotating magnetic field, and a rotation shaft 720 that is disposed to pass through the rear surface of the tub body 202 and connects the rotor 702 and the drum 300 to each other.

The gasket 400 that connects the laundry inlet 101 and the tub opening 201 to each other is means for not only preventing the water stored in the tub body 202 from being discharged into the cabinet 100 through the tub opening 201, but also damping the vibration of the tub body 202 from being transmitted to the cabinet 100.

The gasket 400 may be made of an elastic body (rubber or the like) and include a gasket body 410 that connects the laundry inlet 101 and the tub opening 201 to each other. The gasket body 410 may be constructed to include a first fixed body having a cylindrical shape and having one end fixed to the laundry inlet 101, a second fixed body having a cylindrical shape and having the other end fixed to the tub opening 201, and a connecting body for connecting a free end of the first fixed body and a free end of the second fixed body to each other.

A diameter of the free end of the second fixed body may be set larger than a diameter of the free end of the first fixed body. The connecting body for connecting the two free ends to each other is preferably constructed to include at least one inflection point. When the at least one inflection point is included in the connecting body, it is possible to effectively block the vibration of the tub body 202 from being transmitted to the cabinet 100.

The number of inflection points formed in a lower space of the connecting body may be set to be greater than the number of inflection points located in an upper space of the connecting body. This is a result of considering that water introduced into the connecting body is concentrated in the lower space of the connecting body. Because the water introduced into the connecting body will be concentrated in the lower space of the connecting body by gravity, it may be advantageous in terms of residual water removal that a volume of the lower space of the connecting body is set to be greater than a volume of the upper space of the connecting body.

The gasket 400 may have a gasket guide 420 protruding from an outer periphery of the gasket body 410 to define a flow path therein. A nozzle portion 620 may be inserted into the flow path defined in the gasket guide 420. A detailed structure thereof will be described later.

Wash water may be stored in the tub 200 and may be supplied through a water supply 10 from an external water supply source located outside the laundry treating apparatus. In addition, the wash water stored in the tub 200 may be discharged to the outside through a drainage 20. A tub drain tube 206 may be disposed at a lower end of the tub 200, so that water discharged to the tub drain tube 206 by gravity may be discharged to the outside of the laundry treating apparatus through the drainage 20.

The process of introducing the water into the laundry treating apparatus and discharging the water to the outside is accomplished by the water supply 10 and the drainage 20, but it is also possible for the water stored in the tub 200 to circulate. It is also possible that the water drained from the tub 200 to the tub drain tube 206 is pumped by a pump 500 and supplied to the tub 200 again.

The water pumped by the pump 500 may be supplied back into the tub 200 through a circulation portion 600. Contents of the circulation portion 600 will be described later.

The laundry treating apparatus 1 of the present disclosure may be constructed to have a structure different from the above-described structure. When describing the laundry treating apparatus 1 of another structure with reference to FIG. 2, unlike in the structure described above, the tub 200 may be fixedly disposed inside the cabinet 100.

The laundry treating apparatus of the corresponding structure includes the cabinet 100 having the laundry inlet defined therein, the tub 200 fixed to the cabinet 100 and having the tub opening 201 defined therein in communication with the laundry inlet, the drum 300 rotatably disposed inside the tub 200 and having the drum opening 301 defined therein in communication with the tub opening 201, a driver (not shown) including a bearing housing 710 that rotatably supports the rotation shaft 720 connected to the drum 300 and a driving motor (not shown) that rotates the rotation shaft 720, a suspension 800 connected to the bearing housing 710 and buffering the vibration of the drum 300, and the gasket 400 that connects the laundry inlet 101 and the tub opening 201 to each other.

The tub 200 may include a front tub 203 constituting a front portion and a rear tub 204 constituting a rear portion. The front tub 203 and the rear tub 204 may be assembled with a screw, and define therein a space in which the drum is accommodated. The rear tub 204 may have an opening defined in a rear surface thereof, so that a rear gasket 401 may be connected to an inner periphery of the opening. In addition, the rear gasket 401 may be connected to a back tub 205, and the back tub 205 may have a through-hole through which the rotation shaft passes at a center thereof.

The rear gasket 401 is connected to be sealed with both the back tub 205 and the rear tub 204 to prevent the wash water in the tub 200 from leaking. The back tub 205 vibrates together with the drum 300 when the drum 300 rotates. In this connection, the back tub 205 may be spaced apart from the rear tub 204 by a sufficient spacing so as not to interfere with the rear tub 204. In addition, the rear gasket 401 may be made of a flexible material to allow the back tub 205 to move relative to the rear tub 204 without interfering with the rear tub 204. In addition, the rear gasket 401 may have a corrugation that may extend with a sufficient length to allow the relative motion of the back tub 205.

In the present embodiment, the rear gasket 401 is connected to the back tub 205, but the present disclosure is not limited thereto. The rear gasket 401 may not only seal between the driver (not shown) including the rotation shaft 720, the bearing housing 710, and the like, and the rear tub 204, but also allow the driver to move relative to the tub 200. Therefore, the rear gasket 401 may not be limited by a shape thereof or an object to be connected thereof when such a function is able to be achieved.

In one example, the gasket 400 made of a flexible member may be coupled to a front portion of the front tub 203 to connect the tub opening 201 defined in the front tub 203 and the laundry inlet 101 to each other. In addition, the gasket 400 may prevent the wash water from leaking out of the tub 200.

The drum 300 may include a front drum 302, a center drum 304, a back drum 306, and the like. In addition, a front ball balancer 303 and a rear ball balancer 305 may be installed in front and rear portions of the drum, respectively. The back drum 306 may be connected to a spider 307, and the spider 307 may be connected to the rotation shaft 720. The drum 300 is rotated in the tub 200 by the rotation force transmitted through the rotation shaft 720.

The rotation shaft 720 may be connected to the motor (not shown) through the back tub 205. In the present embodiment, the motor may be concentrically connected to the rotation shaft 720. That is, in the present embodiment, the motor may be directly connected to the rotation shaft 720. Specifically, the rotor of the motor and the rotation shaft 720 may be directly connected to each other. In one example, the motor and the rotation shaft 720 may be indirectly connected to each other without being directly connected to each other, and may be, for example, connected to each other by a belt or the like.

The bearing housing 710 may be coupled to a rear surface of the back tub 205. In addition, the bearing housing 710 serves to rotatably support the rotation shaft 720 at to location between the motor and the back tub 205.

A stator (not shown) is fixedly installed on the bearing housing 710. In addition, the rotor may be positioned around the stator. As described above, the rotor may be directly connected to the rotation shaft 720. In one example, the motor may be constructed as an outer rotor-type motor, and may be directly connected to the rotation shaft 720.

The rotation shaft 720 may be installed horizontally with the base 102. However, the rotation shaft 720 may be installed to be inclined with the base 102. That is, the rotation shaft 720 may be disposed such that a distance from the base 102 increases in a direction from the bearing housing 710 to the drum 300. That is, the drum 300 may be disposed to rise frontwardly, which has an effect of facilitating withdrawal of the laundry accommodated in the drum 300 by the user.

The bearing housing 710 may be supported through the suspension 800 from the cabinet base 102. The suspension 800 may include a vertical support and an inclined support for inclinedly supporting the bearing housing 710 with respect to a front and rear direction. For example, in the present embodiment, the suspension 800 may include three vertical supports and two inclined supports for inclinedly supporting the bearing housing 710 with respect to the front and rear direction. In one example, the suspension 800 may not be connected to the cabinet base 102 in a fully stationary manner, and may be connected to the cabinet base 102 to allow some degree of elastic deformation to allow movements of the drum in the front and rear direction and/or in a left and right direction. That is, the suspension 800 may be elastically supported to allow some degree of rotation in the front and rear direction and in the left and right direction with respect to a support point thereof connected to the base 102. For such elastic support, the vertically installed suspension 800 may be installed on the base 102 via a rubber bushing.

The vertical support of the suspension 800 may be constructed to elastically buffer the vibration of the drum 300, and the inclined support may be constructed to damp the vibration. That is, in a vibration system including a spring and damping means, the vertical support may serve as the spring, and the inclined support may serve as the damping means.

The tub 200 may be supported by the cabinet 100, and the vibration of the drum 300 may be buffered and supported by the suspension 800. Therefore, the laundry treating apparatus according to the present embodiment may have a shape in which support structures of the tub 200 and the drum 300 are substantially separated from each other, or may have a structure in which the vibration of the drum 300 is not directly transmitted to the tub 200.

There is an effect of reducing a vibration noise occurred by the rotation of the drum 300 by preventing the transmission of the vibration between the drum 300 and the tub 200 as such.

A tub rim 230 protruding in a direction toward the facing cabinet 100 along a circumference of the tub opening 201 may be disposed. The tub rim 230 may protrude from the tub opening 201 by a constant length along the circumference. However, the tub rim 230 may have a length protruding from an upper portion of the tub opening 201 greater than a length protruding from a lower portion of the tub opening 201.

When the drum 300 and the tub 200 are disposed to rise frontwardly as described above, a distance at which a top of a front surface of the tub 200 is spaced apart from the laundry inlet 101, which is defined to be perpendicular to the ground, may become greater than a distance between a bottom of the front surface of the tub 200 and the laundry inlet 101. Therefore, positions of the laundry inlet 101 and the tub opening 201 may be matched by adjusting the protruding length of the tub rim 230.

The gasket 400 may be coupled to the tub rim 230. The gasket 400 may include the cylindrical gasket body 410. The gasket body 410 may be formed in a shape in which two cylinders overlap each other and a rear surface of one cylinder is connected to a front surface of the other cylinder. The gasket body 410 may be coupled to the tub rim 230 such that a portion of the gasket body 410 located inside is in contact with an inner circumferential surface of the tub rim 230 and a portion of the gasket body 410 located outside is in contact with an outer circumferential surface of the tub rim 230. That is, the gasket body 410 may be coupled to the tub rim 230 such that a front end of the tub rim 230 is accommodated inside the gasket body 410.

The present embodiment in which the tub 200 and the drum 300 are supported in a separated manner as described above is able to include the water supply and the drainage like the first embodiment in which the tub 200 and the drum 300 are supported in a coupled manner described above, and includes a circulation portion (see FIG. 3) for circulating the wash water of the tub 200.

Figure 3:
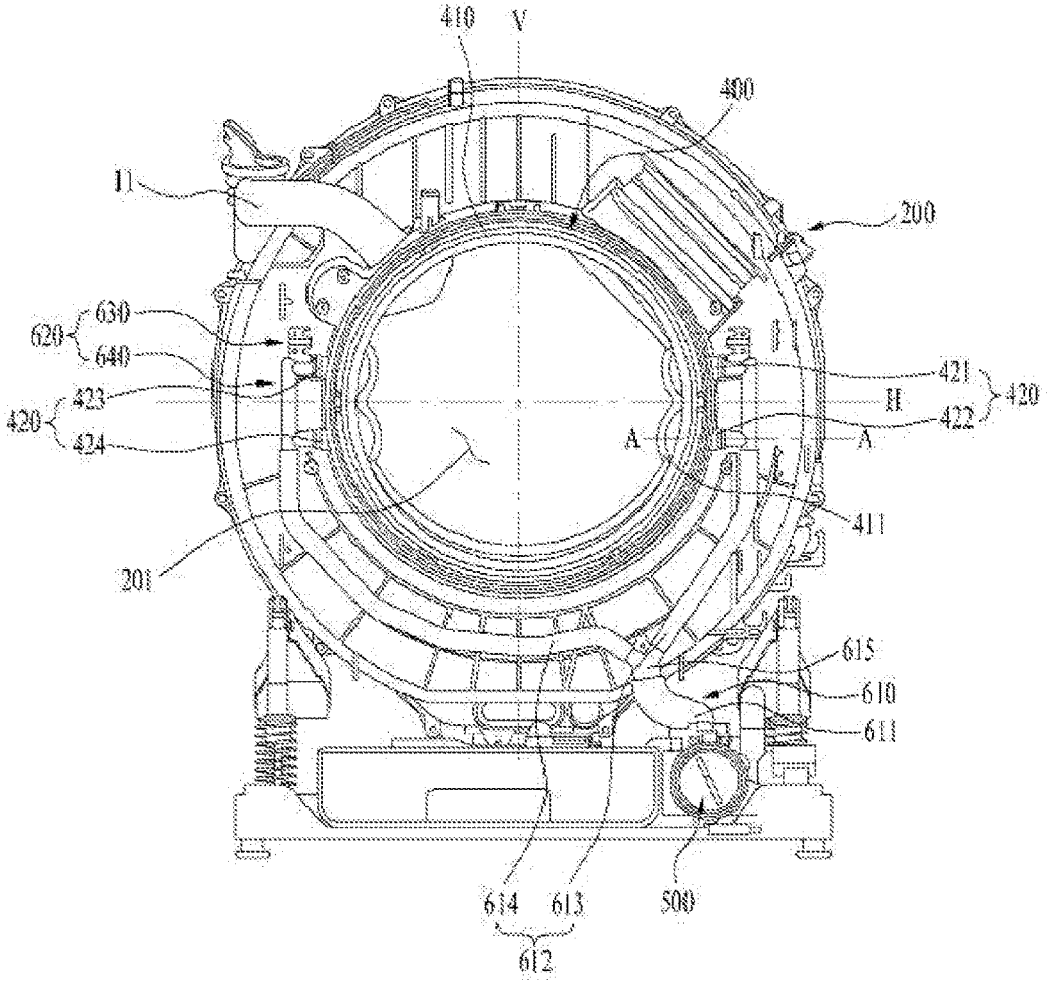
FIG. 3 is a front view showing a circulation portion of a laundry treating apparatus according to an embodiment of the present disclosure.

FIG. 3 is a view showing an embodiment of a laundry treating apparatus in which the tub is fixedly disposed inside the cabinet as described above. A description will be given of the circulation portion 600 for circulating and supplying water to the tub 200 with reference to FIG. 3. Although the description will be achieved based on the example of the laundry treating apparatus constructed as shown in FIG. 2, the circulation portion described in FIG. 3 may also be applied to the laundry treating apparatus illustrated in FIG. 1.

The laundry treating apparatus according to one embodiment of the present disclosure includes the cabinet 100 having the laundry inlet 101 defined therein, the tub 200 disposed inside the cabinet 100 to provide therein the space for storing the water, and having the tub opening 201 defined therein in communication with the laundry inlet 101, the drum 300 rotatably disposed inside the tub 200 to provide therein the space in which the laundry is accommodated, and having the drum opening 301 defined therein in communication with the tub opening 201, a detergent supply 109 disposed inside the cabinet 100 to provide therein a space for storing detergent, the gasket 400 that connects the laundry inlet 101 and the tub opening 201 to each other, the pump 500 that pumps the water discharged from the tub 200 to the tub 200, and the circulation portion 600 that supplies the water pumped by the pump 500 into the tub 200. The circulation portion 600 includes a circulation flow path portion 610 that guides the water pumped by the pump 500 to the gasket 400, and a nozzle portion 620 that is connected to a nozzle coupling portion 630, which is coupled to the tub 200, and to the circulating flow path 610 on one of both sides of the tub opening 201 to spray water into the tub 200. The nozzle portion 620 includes a nozzle spray portion 640 coupled to the gasket 400 to pass therethrough to spray water into the tub 200, and the nozzle coupling portion 630 extending from the nozzle spray portion 640 to be coupled to the tub 200, and supporting the nozzle spray portion 640.

A process of circulating the water inside the tub 200 through the circulation portion 600 is as follows. First, the water stored in the tub 200 is introduced into the pump 500 by the tub drain tube 206 in communication with a through-hole defined at a lower end of the tub. The pump applies a pressure to supply the water introduced through the tub drain tube 206 back to the tub 200, and the pressurized water flows through a supply pipe 611 connected to the pump 500. A branch connector 615 is coupled to an end of the supply pipe 611, so that the water pumped by the pump branches in different directions and flows along branch flow paths 612 connected to the branch connector 615 with the branch connector 615 as a starting point.

In this connection, the fact that the water is guided to the both sides of the tub opening 201 along the branch flow paths 612 from the branch connector 615 may mean that ends of the branch flow paths 612 are located in different regions based on the vertical line V from the center of the tub opening 201. In addition, each nozzle portion 620 may be coupled to each end of the branch flow path 612 to spray the water into the tub 200.

The water flowed to the both sides of the tub opening 201 along the branch flow paths 612 is supplied to the nozzle portions 620. The nozzle portion 620 may be coupled to the gasket 400 disposed in the tub opening 201 to guide water from the outside to the inside of the gasket 400. The water flowing at the exterior of the tub 200 may be sprayed back into the tub 200 through the nozzle portion 620 coupled to the gasket 400.

As such, the water stored inside the tub 200 may be sprayed onto the laundry accommodated in the tub 200 while circulating in the tub 200 in a specific operation during a washing cycle. Washing and rinsing efficiency may be improved by supplying and spraying the water onto the laundry from various directions. In addition, washing and rinsing speeds may be increased to reduce required times through the process in which the wash water is not simply concentrated in a lower portion of the tub 200, but is transferred upwards again and sprayed.

In addition, in the past, there were many cases in which the branch connector 615, the branch flow paths 612, and the nozzle portion 620 constituting the circulation portion 600 were integrally formed. In such a case, there were problems that components required for the circulation portion 600 must be newly manufactured based on a size of the tub opening 201 or the gasket 400, and are not easy to be used for common use.

However, as in the present disclosure, by modularizing the nozzle portion 620, the branch connector 615, and the like, the same nozzle portion 620, branch connector 615, or the like may be applied to laundry treating apparatuses of various models having various sizes, thereby reducing manufacturing and design costs.

In addition, when describing the general nozzle portion 620, because there is a problem of directionality when one surface of the nozzle portion 620 faces and is coupled to the tub 200 and the other surface thereof is open, the nozzle portion coupled on the left side and the nozzle portion coupled on the right side were manufactured to have different sizes.

However, the nozzle portion 620 according to an embodiment of the present disclosure may be applied to the both left and right sides through a structural design of the nozzle portion 620 of the same shape. When the nozzle portion 620 is manufactured as such, it is possible to prevent problems such as an increase in manufacturing time, individualization of the process, inefficiency of management, and increase in cost, which are caused by the difference in the shape of the left and right parts.

The nozzle portion 620 may be coupled to the gasket 400. The gasket 400 may include the gasket body 410 formed in the cylindrical shape as described above to connect the tub opening 201 and the laundry inlet 101 to each other to prevent the water leakage, and the gasket guide 420 protruding from the outer circumferential surface of the gasket body 410 to communicate the inner circumferential surface and the outer circumferential surface of the gasket body 410 to each other.

Referring to FIG. 3, when viewing the tub opening from the front, the gasket guide 420 may include a first guide 421 positioned at an upper right end, a second guide 422 positioned at a lower right end, a third guide 423 positioned at an upper left end, and a fourth guide 424 positioned at a left lower end. However, the present disclosure may not be limited thereto, and a larger or smaller number of gasket guides 420 may be formed.

Assuming the gasket 400 having the first to fourth guides 424 based on FIG. 3, one nozzle portion 620 may be coupled to the first guide 421 and the second guide 422 on the right side, and another nozzle portion 620 may be coupled to the third guide 423 and the fourth guide 424 on the left side.

The nozzle portion 620 is coupled to pass through the gasket 400 as such, and the water pumped from the pump 500 is supplied to the nozzle portion 620 through the circulation flow path portion 610, and is sprayed into the tub 200 from the nozzle portion 620. In the process in which the water is sprayed, the water may collide with a spray guide 411 located on the inner circumferential surface of the gasket body 410, and the water refracted by the collision may be introduced into the drum 300.

Figure 4:
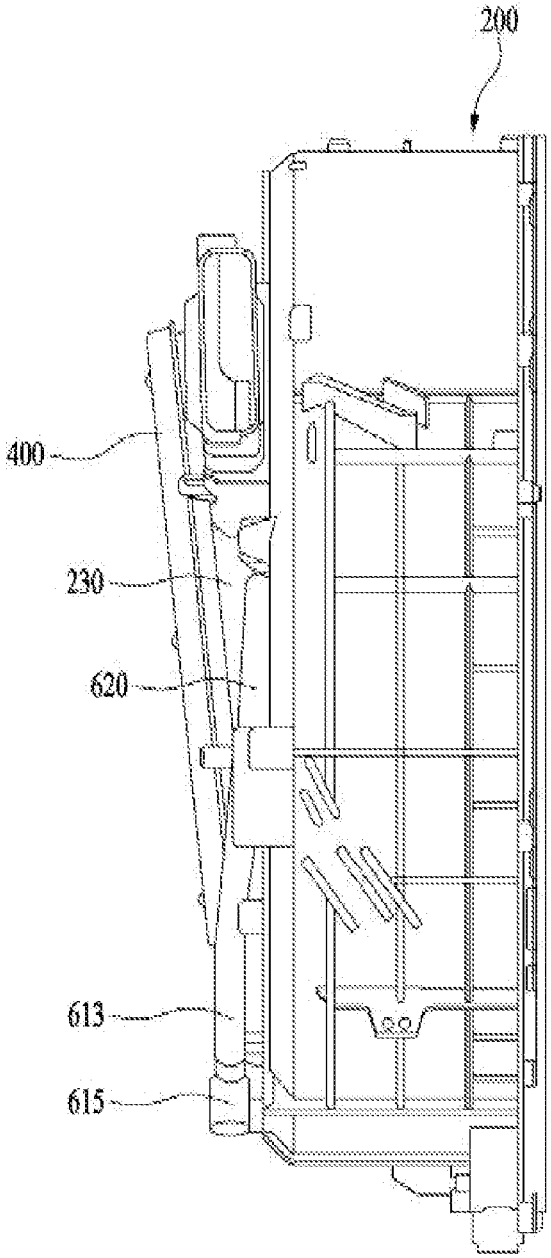
FIG. 4 is a side view showing a circulation portion of a laundry treating apparatus according to an embodiment of the present disclosure.

FIG. 4 is a view of a state in which a tub and a circulation portion of FIG. 3 are coupled to each other, viewed from a right side.

The tub rim 230 may be formed to protrude more from the upper portion than the lower portion of the tub 200. In the case of having the same shape as in one embodiment of the laundry treating apparatus described above in FIG. 2, the tub 200 may be disposed inside the cabinet 100 to be inclined at a predetermined angle with the ground. In this case, in order to match the laundry inlet 101 defined in the front surface of the cabinet 100 and the tub opening 201, the tub rim 230 may be formed such that a length of an upper portion is greater than a length of a lower portion as shown in FIG. 4.

The gasket 400 may be coupled to the tub rim 230. The gasket 400 may be in contact with an outer circumferential surface of the tub rim 230 only by a certain height of the tub rim 230. Although not shown in the drawing, the gasket 400 may be coupled to an inner circumferential surface of the tub rim 230 to be in contact with the entire inner circumferential surface of the tub rim 230.

In addition, the nozzle portion 620 may not be in parallel with the tub 300, but may be disposed such that an upper portion thereof is closer to the tub than a lower portion thereof. That is, the nozzle portion 620 may be formed such that the upper portion thereof is inclined in a direction of the tub 200 based on a plane parallel to the tub opening 201. As such, the nozzle portion 620 may be coupled to the gasket in a manner of occupying a minimum space.

Figure 6:
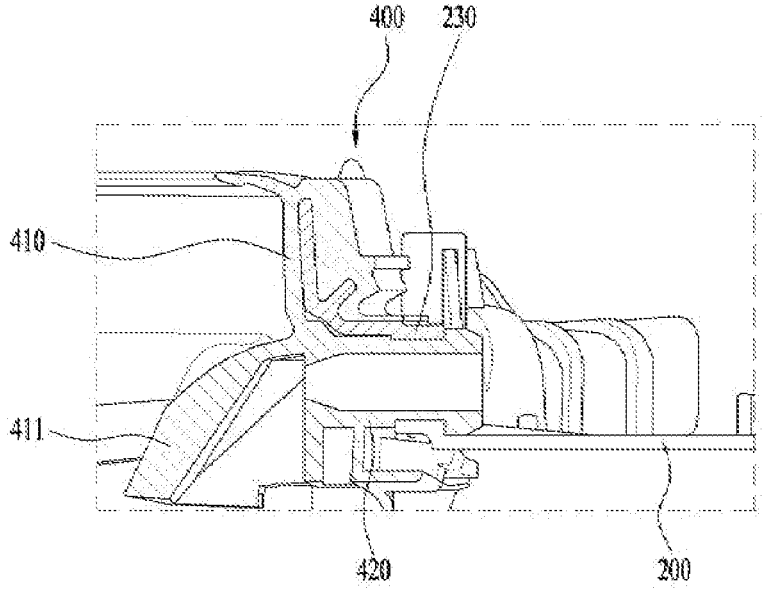
FIG. 6 is a cross-sectional view showing a state before a nozzle portion is coupled to a gasket, according to an embodiment of the present disclosure.
Figure 7:
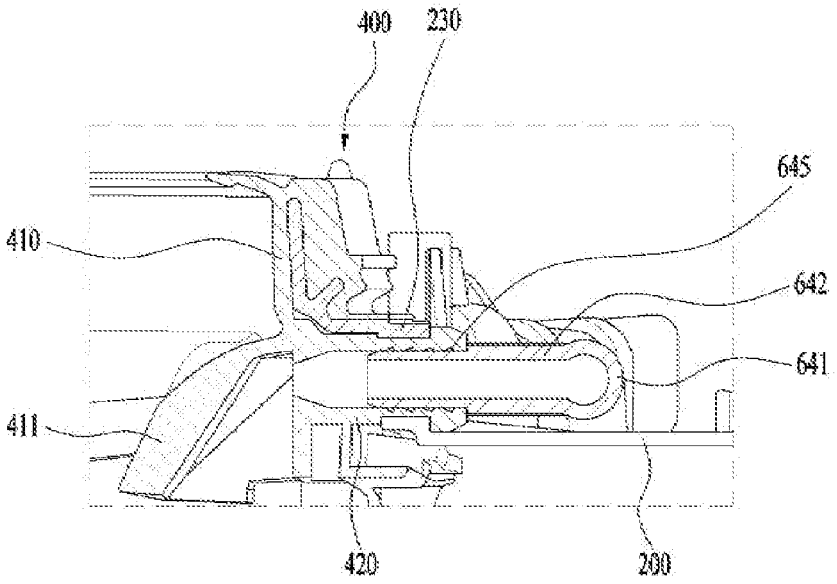
FIG. 7 is a cross-sectional view showing a state in which a nozzle portion is coupled to a gasket, according to an embodiment of the present disclosure.

FIGS. 6 and 7 are cross-sectional views viewing a portion A of FIG. 3 from below. FIG. 6 shows a state before the nozzle portion is coupled, and FIG. 7 shows a state in which the nozzle portion is coupled.

A coupling relationship between the gasket 400 and the tub rim 230 may be described in more detail with reference to FIGS. 6 and 7.

In order to prevent the wash water from leaking out, the gasket 400 may be coupled to the tub rim 230 in double contact. The gasket body 410 may be disposed to be inwardly and outwardly in contact with the tub rim 230. A through-hole may be defined on one side of the tub rim 230 positioned adjacent to the tub opening 201, and the gasket guide 420 may be coupled to the tub rim to pass through the tub rim through the through-hole.

The gasket guide 420 may be coupled to outwardly pass through the through-hole defined in the tub rim 230 as above, and the nozzle portion 620 may be coupled to the gasket guide 420 to spray the water into the tub 200.

Figure 5:
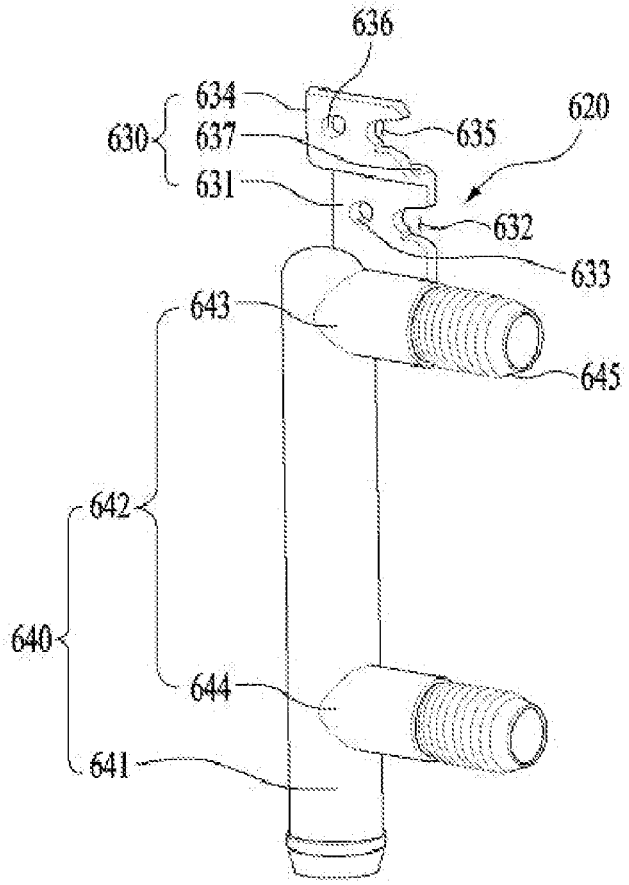
FIG. 5 is a perspective view showing a nozzle portion according to an embodiment of the present disclosure.

FIG. 5 shows a nozzle portion of a laundry treating apparatus according to an embodiment of the present disclosure.

Referring to FIG. 5, the nozzle portion 620 may be composed of the nozzle spray portion 640 that receives the water from the circulation flow path portion 610 and is coupled to the gasket 400 to spray the water, and the nozzle coupling portion 630 that extends from the nozzle spray portion 640 and is coupled to the tub 200.

The nozzle coupling portion 630 may include a first coupling portion 631 extending from the nozzle spray portion 640 and constructed to be coupled to the tub 200, and a second coupling portion 634 extending from the first coupling portion 631 and constructed to be coupled to the tub 200. The first coupling portion 631 and the second coupling portion 634 may be selectively coupled to the tub 200 from the both sides of the tub opening 201.

The fact that the first coupling portion 631 and the second coupling portion 634 are selectively coupled as described above may mean that the first coupling portion 631 is coupled to the tub 200 at one side of the tub opening 201, and the second coupling portion 634 is coupled to the tub 200 at the other side of the tub opening 201.

In the present specification, for convenience of description, the description will be made by assuming that, with respect to the vertical line V in FIG. 3, the right side is one side of the tub opening 201 and the left side is the other side of the tub opening 201. However, the actual embodiment may not be limited thereto, and one side and the other side may be understood in various meanings. For example, when extension lines extending from the center of the tub opening 201 to specific points are different from each other, sides indicated by the extension lines may be expressed as one side and the other side.

The nozzle coupling portion 630 may further include an extension coupling portion 637 that connects the first coupling portion 631 and the second coupling portion 634 to each other. The extension coupling portion 637 may connect the first coupling portion 631 and the second coupling portion 634 to each other in a stepped manner with respect to the tub 200.

When the first coupling portion 631 and the second coupling portion 634 are connected to each other in the stepped manner with respect to the tub 200, distances at which the first coupling portion 631 and the second coupling portion 634 are spaced apart from the tub 200 may be different from each other when the nozzle portion 620 is coupled to the gasket 400.

The first coupling portion 631 may include a first coupling guide 632 that guides the coupling of the nozzle spray portion 640 to the gasket 400 at one side of the tub opening 201, and a first coupling hole 633 coupled to a nozzle boss 210 at one side of the tub opening 201.

The second coupling portion 634 may include a second coupling guide 635 that guides the coupling of the nozzle spray portion 640 to the gasket 400 at the other side of the tub opening 201, and a second coupling hole 636 coupled to the nozzle boss 210 at the other side of the tub opening 201.

The first coupling hole 633 and the second coupling hole 636 may be defined to pass through the first coupling portion 631 and the second coupling portion 634, respectively. The first coupling guide 632 and the second coupling guide 635 may be defined to be recessed from one side of the first coupling portion 631 and the second coupling portion 634, respectively.

A fastening member such as a screw or a bolt may pass through and be inserted into the first coupling hole 633 and the second coupling hole 636 to couple the tub 200 and the nozzle coupling portion 630 to each other. In addition, the first coupling guide 632 and the second coupling guide 635 may limit a depth at which the nozzle spray portion 640 is inserted into the gasket 400 by the first tub protrusion 212 or the second tub protrusion 214 formed in the tub 200.

The nozzle spray portion 640 may include a nozzle pipe 641 connected to the circulation flow path portion 610 and having a nozzle flow path defined therein, and a discharge pipe 642 extending from the nozzle pipe 641 and inserted into the gasket guide 420 and having a spray flow path in communication with the nozzle flow path defined therein.

The nozzle pipe 641 may be connected to the branch flow path 612 of the circulation flow path portion 610 to receive the water through the nozzle flow path defined therein. The water that has passed through the nozzle pipe 641 may flow through the discharge pipe 642 that defines the spray flow path therein in communication with the nozzle flow path.

Both the nozzle pipe 641 and the discharge pipe 642 may be manufactured in a pipe shape to allow the water to flow therein, and may change a flow direction of the water.

The discharge pipe 642 may include a plurality of discharge pipes, and may be composed of a first discharge pipe 643 and a second discharge pipe 644 from the top. The number of discharge pipes 642 may not be limited and may be various as needed.

The first discharge pipe 643 and the second discharge pipe 644 may be constructed to be vertically spaced apart from each other in the state of being coupled to the gasket 400. In addition, the first discharge pipe 643 and the second discharge pipe 644 may extend to be in parallel with each other.

Because the rubber material of the gasket has a certain strength, when the discharge pipes are directed toward the center of the tub opening so as not to be in parallel with each other, a working time may increase in the process of inserting the discharge pipe into the gasket guide, and the insertion may not be easy. Therefore, when the plurality of discharge pipes are constructed to be in parallel with each other as described above, the coupling with the gasket is strengthened, and a working efficiency is increased.

A pipe protruding portion 645 having an increasing or decreasing diameter may be formed at an end of the discharge pipe 642. The pipe protruding portion 645 may be formed to have a screw shape, and a maximum outer diameter of the pipe protruding portion 645 may be smaller than an outer diameter of the discharge pipe 642 at a point where the pipe protruding portion 645 starts.

The pipe protruding portion 645 may be inserted into the gasket guide 420. When the gasket guide 420 made of the flexible material and the pipe protruding portion 645 are coupled to each other, there is an effect of preventing water leakage through the gasket guide 420.

When the discharge pipe 642 is inserted into the gasket guide 420, the discharge pipe 642 may be inserted only up to a point where the pipe protruding portion 645 is formed. It is preferable to insert only a portion of the discharge pipe 642 where the pipe protruding portion 645 is formed into the gasket guide 420 for the purpose of preventing the water leakage. However, the present disclosure may not be limited thereto and the discharge pipe 642 may be inserted at various depths.

Figure 8:
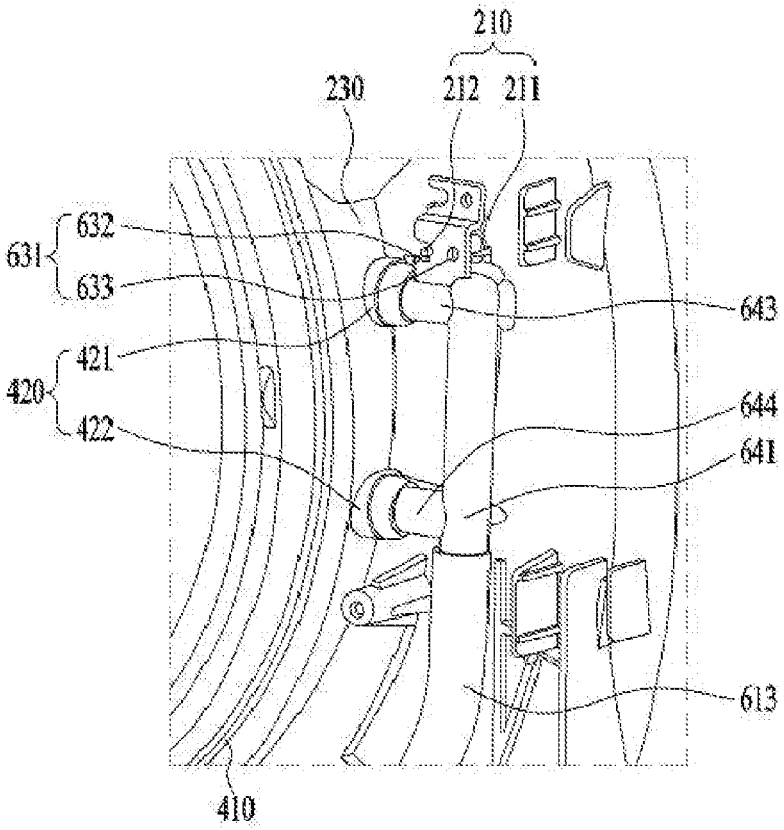
FIG. 8 shows a state in which a nozzle portion according to an embodiment of the present disclosure is coupled at one side of a tub opening.

FIG. 8 is an enlarged view of a state in which the nozzle portion 620 is coupled to the gasket 400 located on one side of the tub opening.

Referring to FIG. 8, the gasket guide 420 is installed through the tub rim 230. The above-described discharge pipe 642 is coupled to the gasket guide 420. When viewing the nozzle coupling portion 630, the first coupling portion 631 is coupled to the tub 200 to be in contact therewith at one side of the tub opening 201.

The nozzle boss 210 protruding toward the nozzle coupling portion 630 is formed in the tub 200. The nozzle boss 210 may provide a point at which the nozzle coupling portion 630 is coupled to the tub 200. Because the tub 200 is the space in which the water is stored, when the nozzle coupling portion 630 is coupled to a surface of the tub 200 in a penetrating manner using a member such as a screw, there is a risk of the water leakage as an outer wall of the tub 200 is penetrated. Accordingly, the nozzle boss 210 may be formed in the tub 200 to have a separate thickness and to facilitate the coupling.

The nozzle boss 210 may include a first nozzle boss 211 protruding from the tub 200 to be coupled with the first coupling portion 631 at one side of the tub opening 201. In addition, a first tub protrusion 212 protruding from the tub 200 may be included to determine a depth at which the nozzle spray portion 640 is inserted into the gasket guide 420.

The first nozzle boss 211 may have a predetermined thickness and may be formed in a shape including a fastening hole that may be coupled to the first coupling hole 633 in a manner of being penetrated by a fastening member.

The first tub protrusion 212 may be formed in a shape of a pin protruding from the tub 200 and may serve as a stopper. Assuming that the nozzle portion 620 is coupled from the side, it may be recognized that the discharge pipe 642 of the nozzle spray portion 640 is sufficiently coupled to the gasket guide 420 at a point where the first coupling guide 632 contacts the deepest point of a depression of the first coupling guide 632. In addition, the leakage of the wash water resulted from excessive insertion of the discharge pipe 642 into the gasket guide 420, or, conversely, resulted from insufficient insertion may be prevented.

The first nozzle boss 211 may be formed to protrude from the tub 200 by a predetermined height. The first nozzle boss 211 may be formed to protrude by a distance at which the tub 200 and the first coupling portion 631 are spaced apart from each other in consideration of a position of the first coupling portion 631 at a time when the discharge pipe 642 is coupled to the gasket guide 420.

The first tub protrusion 212 may also protrude by a height at which the first coupling guide 632 is able to be in contact with the first tub protrusion 212 in consideration of a position of the first coupling guide 632 at a time when the discharge pipe 642 is coupled to the gasket guide 420.

Figure 9:
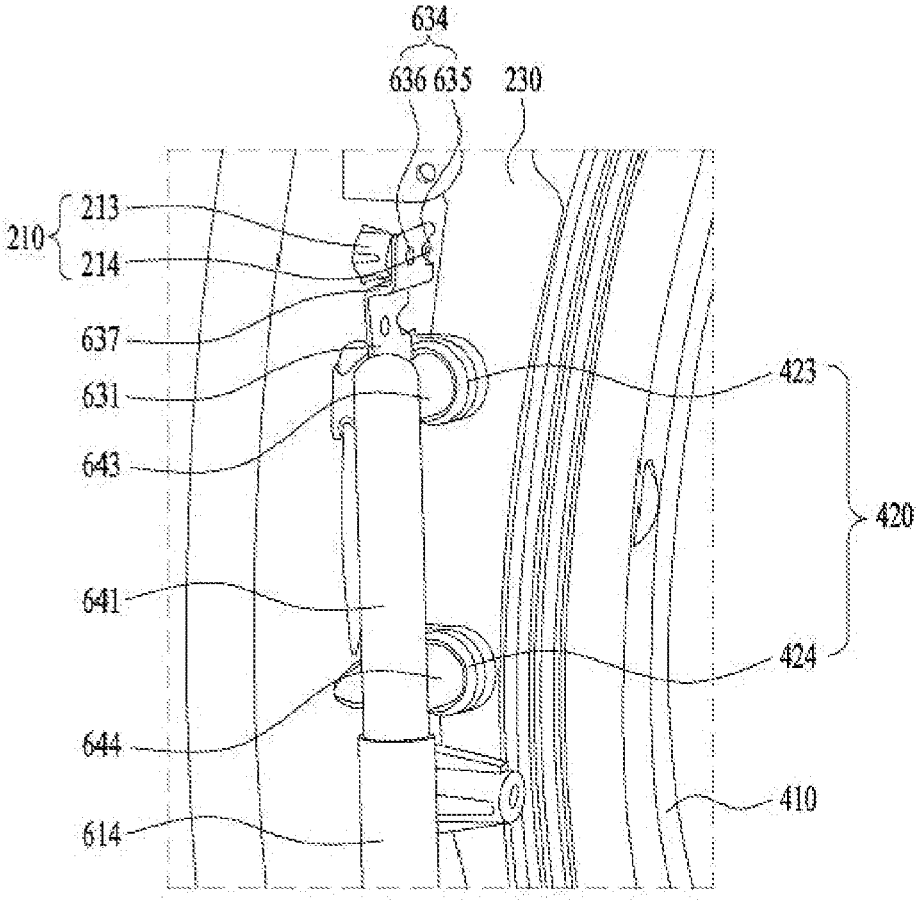
FIG. 9 shows a state in which a nozzle portion according to an embodiment of the present disclosure is coupled at the other side of a tub opening.

FIG. 9 is an enlarged view showing a state in which the nozzle portion 620 is coupled to the gasket 400 located on the other side of the tub opening 201.

Referring to FIG. 9, the gasket guide 420 is installed through the tub rim 230 as on one side of the tub opening 201. The above-described discharge pipe 642 is coupled to the gasket guide 420. When viewing the nozzle coupling portion 630, the second coupling portion 634 is coupled to the tub 200 to be in contact with the tub 200 contrary to the fact that the first coupling portion 631 is coupled to the tub 200 to be in contact with the tub 200 on one side of the tub opening 201.

Looking at a difference from one side of the tub opening 201, the second coupling portion 634 is in contact with the tub 200. This may be seen as a difference that occurs as the same nozzle portion 620 is commonly used for the left and right sides.

The nozzle boss 210 disposed on the other side of the tub opening 201 may include a second nozzle boss 213 protruding from the other side of the tub opening 201 and coupled to the second coupling portion 634, and a second tub protrusion 214 protruding from the tub 200 to determine a depth at which the nozzle spray portion 640 is inserted into the gasket guide 420 at the other side of the tub opening 201.

The second nozzle boss 213 and the second tub protrusion 214 may be coupled to correspond to the second coupling hole 636 and the second coupling guide 635 defined in the second coupling portion, respectively. Detailed coupling structure and process are similar to those in which the first coupling portion 631, the first nozzle boss 211, and the first tub protrusion 212 are coupled to each other at one side of the tub opening 201, so that a detailed description thereof will be omitted.

The first nozzle boss 211 and the second nozzle boss 213 may be formed to have different distances spaced from the bottom surface of the cabinet 100. As described above, the first nozzle boss 211 is coupled to the first coupling portion 631, the second nozzle boss 213 is coupled to the second coupling portion 634, and relative heights of the first coupling portion 631 and the second coupling portion 634 from the installation plane are different, so that the heights of the first nozzle boss 211 and the second nozzle boss 213 may be different from each other for ease of coupling. This may be applied to the first tub protrusion 212 and the second tub protrusion 214 as well.

However, this may be changed based on specific shapes and placement positions of the first coupling portion 631 and the second coupling portion 634. For example, when the first coupling portion 631 and the second coupling portion 634 are disposed on the side surface of the nozzle spray portion 640, distances at which the first nozzle boss 211 and the second nozzle boss 213 are spaced apart from the tub opening 201 in a horizontal direction may become different from each other.

When schematically summarizing the coupling relationship of the nozzle portion 620 described above, the first coupling portion 631 may include the first coupling guide 632 that guides the coupling of the nozzle spray portion 640 to the gasket 400 at one side of the tub opening 201, and the first coupling hole 633 coupled to the nozzle boss 210 at one side of the tub opening 201, and the second coupling portion 634 may include the second coupling guide 635 that guides the coupling of the nozzle spray portion 640 to the gasket 400 at the other side of the tub opening 201, and the second coupling hole 636 coupled to the nozzle boss 210 at the other side of the tub opening 201.

In addition, the nozzle boss 210 may include the first nozzle boss 211 and the first tub protrusion 212 disposed on one side of the tub opening 201, and the second nozzle boss 213 and the second tub protrusion 214 disposed on the other side.

The first tub protrusion 212 may be disposed closer to the tub opening 201 than the first nozzle boss 211, and the second tub protrusion 214 may be disposed closer to the tub opening 201 than the second nozzle boss 213.

Referring to FIGS. 5 to 7, the gasket 400 may include the gasket body 410 that connects the laundry inlet 101 and the tub opening 201 to each other, and the gasket guide 420 that protrudes from an outer circumferential surface of the gasket body 410 and communicates an inner circumferential surface and the outer circumferential surface of the gasket body 410. The nozzle spray portion 640 may be inserted into the gasket guide 420.

In addition, as described above, the tub 200 may include the tub rim 230 extending along a circumference of the tub opening, and the gasket guide 420 may be coupled to the tub rim 230 to penetrate the tub rim 230.

In addition, the nozzle spray portion 640 may include the nozzle pipe 641 connected to the circulation flow path portion 610 and having the nozzle flow path defined therein, and the discharge pipe 642 extending from the nozzle pipe 641 and inserted into the gasket guide 420 and having the spray flow path in communication with the nozzle flow path defined therein.

The pipe protruding portion 645 extending from a free end of the discharge pipe 642 to be away from the nozzle pipe 641, and having the diameter increasing or decreasing along an extending direction may be formed, and the pipe protruding portion 645 may be inserted into and coupled to the gasket guide 420.

The pipe protruding portion 645 is preferably formed at an end of the discharge pipe 642 as a component of the discharge pipe 642. However, the present disclosure may not be limited thereto, and the pipe protruding portion 645 may be formed on a circumferential surface of the discharge pipe 642 except for the end of the discharge pipe 642.

Figure 10:
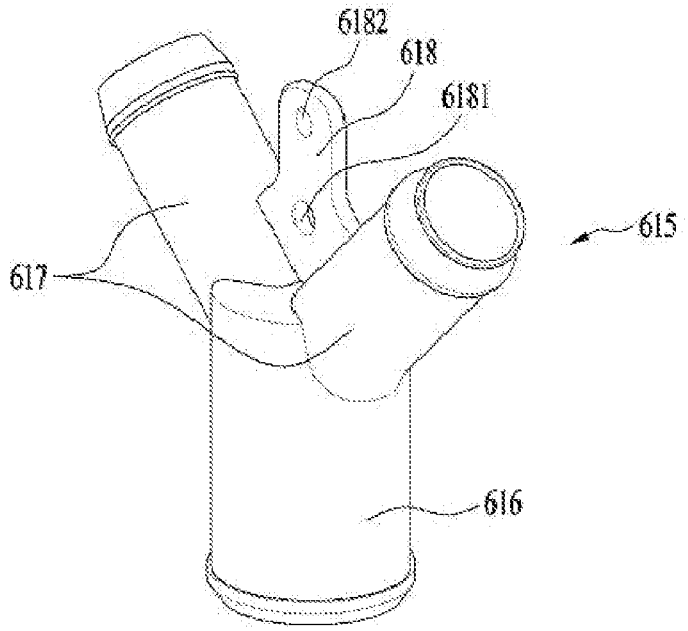
FIG. 10 shows a nozzle branch according to an embodiment of the present disclosure.

FIG. 10 shows a branch connector of a laundry treating apparatus according to an embodiment of the present disclosure.

Referring to FIG. 3, the circulation flow path portion 610 that supplies the water pumped from the pump 500 to the nozzle portion 620 may include the supply pipe 611 connected to the pump, the branch connector 615 connected to the supply pipe 611 to branch the water supplied from the supply pipe 611, and each branch flow path 612 that connects the branch connector 615 and the nozzle portion 620 to each other.

Referring to FIG. 10, the branch connector 615 may include a water supply pipe 616 connected to the supply pipe 611, drain pipes 617 extending in different directions from the water supply pipe 616 and coupled to the branch flow paths 612, and a connector coupling portion 618 extending from the branch connector 615 or the water supply pipe 616 and coupled to the tub.

As described above, in the prior art, the nozzle portion 620 and the circulation flow path portion 610 constituting the circulation portion 600 were integrally formed, so that universal use was difficult. However, because the branch connector 615 is applicable to various models, there is an effect of reducing manufacturing cost and design cost and increasing transportation convenience.

In addition, as the connector coupling portion 618 is formed, the branch connector 615 may be firmly coupled to the tub 200, and decoupling between the branch connector 615 and the supply pipe 611 and between the branch connector 615 and the branch flow path 612 by a pressure resulted from a flow of the circulating water may be prevented.

Figure 11:
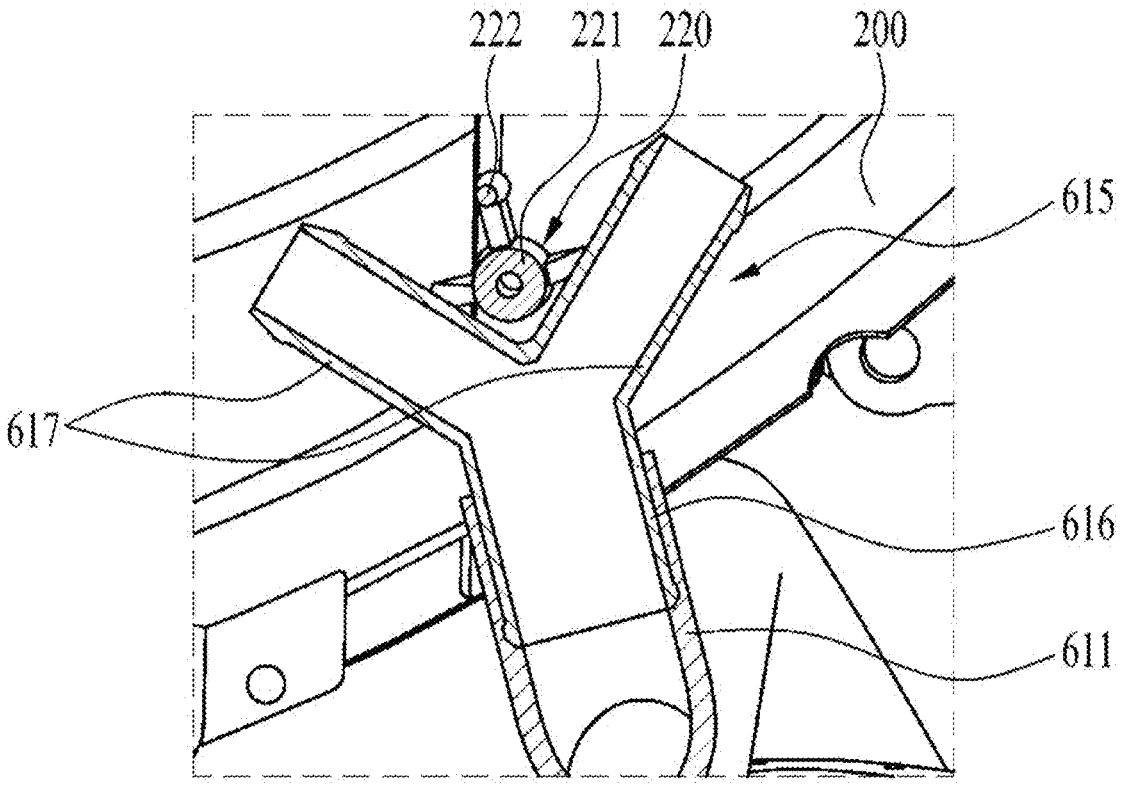
FIG. 11 is a cross-sectional view showing a state in which a nozzle branch according to an embodiment of the present disclosure is coupled.

FIG. 11 is a cross-sectional view enlarging a portion in which a branch connector is coupled to a tub.

Referring to FIG. 11, the tub 200 may further include a connector boss 220 that protrudes toward the connector coupling portion 618 and is coupled to the connector coupling portion 618. The connector boss 220 may be composed of a first connector boss 221 and a first connector protrusion 222.

The first connector protrusion 222 may be formed in a shape of a pin protruding from the tub to guide a displacement position of the branch connector 615 in a manner of being inserted into the first coupling guide 632. The first connector boss 221 may be formed to protrude from the tub by a predetermined height, and may be coupled by a fastening member penetrating a connector coupling hole 6181 and the first connector boss 221 at the same time.

In such manner, the branch connector 615 may be firmly fixed to the tub 200 using the connector coupling portion 618, and the decoupling thereof by the pressure resulted from the flow of the circulating water may be prevented.

Figure 12:
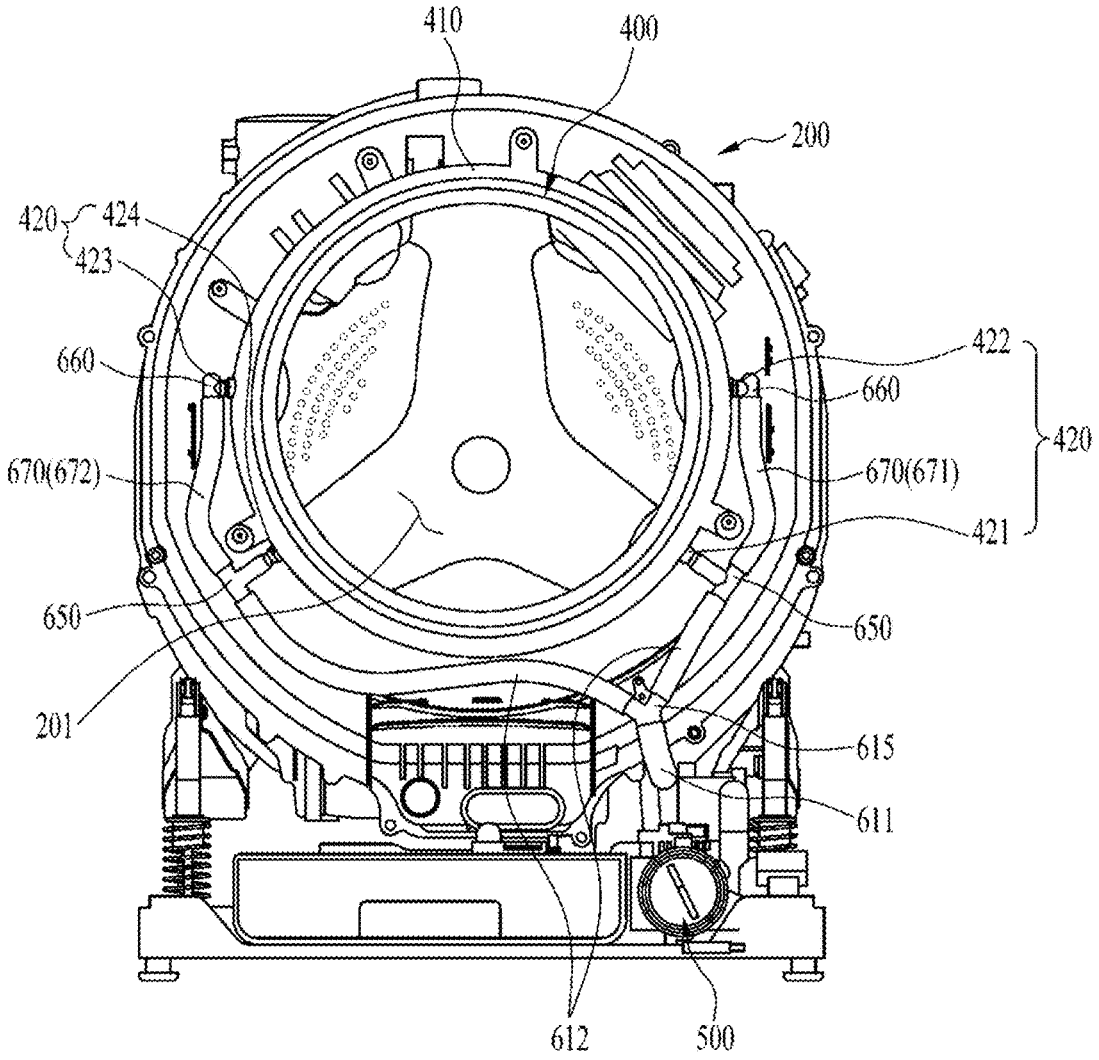
FIG. 12 is a front view showing a circulation portion according to an embodiment of the present disclosure.

FIG. 12 illustrates a circulation portion of a laundry treating apparatus according to another embodiment of the present disclosure.

Referring to FIG. 12, other components except for the circulation portion 600 are the same as those shown in FIG. 3. In particular, it may be seen that the shape of the nozzle portion 620 among the components of the circulation portion 600 is changed.

Referring to FIG. 3 again, the laundry treating apparatus according to one embodiment of the present disclosure may include a guide tube 11 having one end coupled to the detergent supply 109, and the other end coupled to the gasket 400 to supply the detergent stored in the detergent supply 109 into the tub 200.

The water introduced through the water supply 10 may flow along the guide tube 11 through the detergent supply 109. The guide tube 11 may be inserted into and coupled to the gasket 400 from one side to supply water necessary for the washing into the tub 200.

As described above, when each of the nozzle portion 620 and the branch connector 615 are formed as one part and the branch flow path 612 for connecting the both components to each other is manufactured as a hose made of a rubber material, even when the space between the tub 200 and the cabinet 100 is narrow, the both components may be easily coupled to each other. In addition, there is an effect of increasing ease of manufacture, transport, and assembly.

In one example, the laundry treating apparatus according to one embodiment of the present disclosure includes the cabinet 100 having the laundry inlet 101 defined therein, the tub 200 fixed inside the cabinet 100 and having the tub opening 201 defined therein in communication with the laundry inlet 101, the drum 300 rotatably disposed inside the tub 200 and having the drum opening 301 defined therein in communication with the tub opening 201, the driver 700 including the bearing housing 710 that rotatably supports the rotation shaft 720 connected to the drum 300 and the driving motor that rotates the rotation shaft 720, the suspension 800 connected to the bearing housing 710 and buffering the vibration of the drum 300, the gasket 400 that connects the laundry inlet 101 and the tub opening 201 to each other, the pump 500 that pumps the water discharged from the tub 200 to the tub 200, and the circulation portion 600 that supplies the water pumped by the pump 500 into the tub 200. The circulation portion 600 includes the circulation flow path portion 610 that guides the water pumped by the pump 500 by branching the water to the both sides of the tub opening 201, and the nozzle portion 620 including the nozzle spray portion 640 coupled to the gasket 400 from each of the both sides of the tub opening 201 to spray the water into the tub 200. The nozzle spray portion 640 is disposed such that one surface of the nozzle spray portion 640 faces the tub 200 on one side of the tub opening 201 and the other surface of the nozzle spray portion 640 faces the tub 200 on the other side of the tub opening 201.

The gasket 400 may include the gasket body 410 that connects the laundry inlet 101 and the tub opening 201 to each other, and the gasket guide 420 that protrudes from the outer circumferential surface of the gasket body 410 and communicates the inner circumferential surface and the outer circumferential surface of the gasket body 410. The nozzle spray portion 640 may be inserted into the gasket guide 420. The tub 200 may include the tub rim 230 that protrudes forward from the circumference of the tub opening 201, and the gasket guide may be coupled to the tub rim 230 by penetrating the tub rim 230. It may be formed in the same manner as in the embodiment regarding the tub rim described above.

The nozzle portion 620 may be composed of only the nozzle spray portion 640 without the separate nozzle coupling portion 630. The nozzle spray portion 640 may include a first nozzle 650 connected to the circulation flow path portion 610 and the gasket guide 420, and having an open flow path defined therein at one side thereof, a second nozzle 660 connected to another portion of the gasket guide 420, and a spray connection flow path 670 connecting the first nozzle 650 and the second nozzle 660 to each other.

The gasket guide 420 may be composed of the first guide 421, the second guide 422, the third guide 423, and the fourth guide 424. The first nozzle 650 may be connected to each of the second guide 422 and the fourth guide 424, and the second nozzle 660 may be coupled to each of the first guide 421 and the third guide 423.

The first nozzle 650 and the second nozzle 660 may be applied to both left and right sides. The spray connection flow path 670 connecting the first nozzle 650 and the second nozzle 660 to each other may also be commonly used for the left and right sides.

Even when applied to various laundry treating apparatus having different sizes of the tub opening 201 and the gasket 400, the first nozzle 650 and the second nozzle 660 are used in the same manner, and the spray connection flow path 670 is used in a manner in which only a length thereof is changed, thereby increasing versatility. In addition, all of the first nozzle 650, the second nozzle 660, and the spray connection flow path 670 may be applied to both left and right sides, so that manufacture, design, and storage are easy as types of parts are reduced.

When the first nozzle 650 is coupled to one side of the tub opening 201, one surface of the first nozzle 650 may be positioned to face the tub 200. When the first nozzle 650 is coupled to the other side of the tub opening 201, the other surface of the first nozzle 650 may be positioned to face the tub 200. Such positional relationship may be equally applied to the second nozzle 660 and the spray connection flow path 670.

Figure 13:
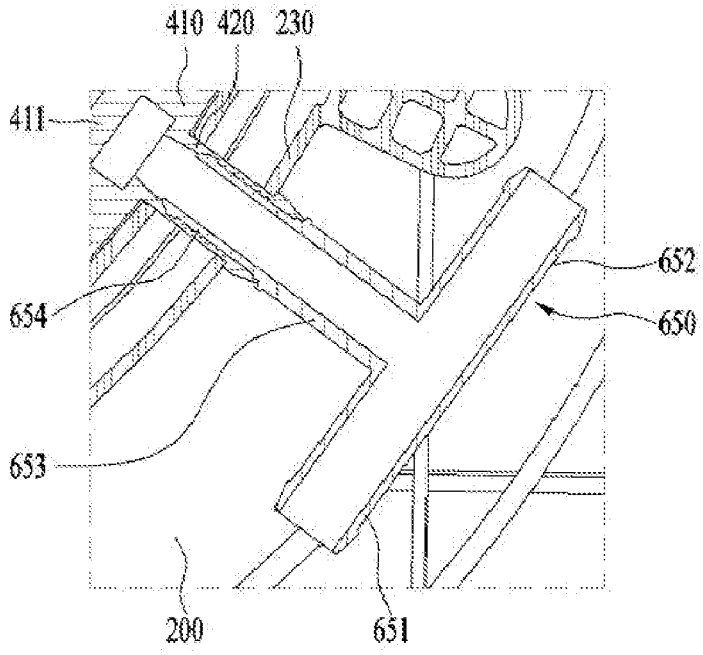
FIG. 13 is a cross-sectional view showing a state in which a first nozzle according to an embodiment of the present disclosure is coupled.
Figure 14:
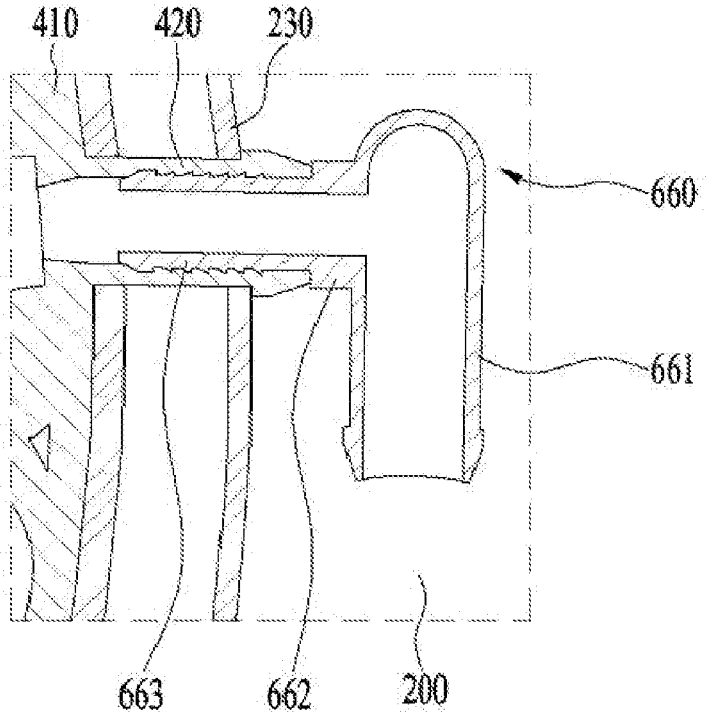
FIG. 14 is a cross-sectional view showing a state in which a second nozzle according to an embodiment of the present disclosure is coupled.

FIGS. 13 and 14 are cross-sectional views showing enlarged first nozzle and second nozzle on one side of a tub opening of FIG. 12, respectively.

Referring to FIGS. 12 and 13, the water may be supplied to the first nozzle 650 through a first supply pipe 651 to which the circulation flow path portion 610 is connected. In addition, the supplied water may branch and flow to a first spray pipe 653 and a first discharge pipe 652 coupled to the gasket.

When viewing the first spray pipe 653, the gasket guide 420 penetrates the tub rim 230 to be exposed to the outside of the tub 200, and the first spray pipe 653 is coupled to the gasket guide 420. A first pipe protruding portion 654 may be formed at an end of the first spray pipe 653, and may be formed in a shape in which an outer diameter thereof increases or decreases to increase a coupling force with the gasket guide 420.

When viewing the first discharge pipe 652, the first discharge pipe may be coupled to the spray connection flow path 670. That is, a portion of the water supplied through the circulation flow path portion is supplied into the tub 200 through the first spray pipe 653, and another portion is supplied to the second nozzle 660 by flowing along the spray connection flow path 670 through the first discharge pipe 652.

Referring to FIGS. 12 and 14, the second nozzle 660 may be composed of a second supply pipe 661 supplied with the water by the spray connection flow path 670, and a second spray pipe 662 that sprays the water supplied to the second supply pipe 661 into the tub. Similar to the first spray pipe 653, a second pipe protruding portion 663 may be formed at an end of the second spray pipe 662 to increase a coupling force with the gasket guide 420.

As described above, the nozzle spray portion coupled to one side of the tub opening has been described with reference to FIGS. 12 to 14, but coupling to the other side of the tub opening 201 will be possible in the same manner.

Although the present disclosure has been illustrated and described with respect to a particular embodiment, it will be apparent to those of ordinary skill in the art that the present disclosure may be variously improved and changed to the extent not departing from the technical spirit of the present disclosure provided by the following claims.

What is claimed is:

1. A laundry treating apparatus comprising:

a cabinet that defines a laundry inlet configured to receive laundry;

a tub disposed inside the cabinet and configured to receive water, the tub defining a tub opening in communication with the laundry inlet;

a drum rotatably disposed inside the tub and configured to accommodate the laundry, the drum defining a drum opening in communication with the tub opening;

a detergent supply disposed inside the cabinet and configured to store detergent;

a gasket that connects the laundry inlet and the tub opening to each other;

a pump configured to move water discharged from the tub toward the tub; and a circulation portion configured to supply the water moved by the pump into the tub, wherein the circulation portion comprises:

a circulation flow path portion configured to guide the water to the gasket, and a nozzle portion connected to the circulation flow path portion and configured to spray the water into the tub, and wherein the nozzle portion comprises:

a nozzle spray portion that is coupled to and passes through the gasket, the nozzle spray portion being configured to spray the water into the tub, and a nozzle coupling portion that extends from the nozzle spray portion and is coupled to the tub, the nozzle coupling portion supporting the nozzle spray portion, wherein the nozzle portion is one of first and second nozzle portions that are connected to the circulation flow path portion, the first and second nozzle portions being disposed at first and second sides of the tub opening, respectively, wherein the nozzle coupling portion is one of first and second nozzle coupling portions that couple the first and second nozzle portions to the tub, respectively, wherein the first nozzle coupling portion has (i) an upper surface that is in contact with the tub and (ii) a lower surface that is spaced apart from the tub, and wherein the second nozzle coupling portion has (i) an upper surface that is spaced apart from the tub and (ii) a lower surface that is in contact with the tub.

2. The laundry treating apparatus of claim 1, wherein the gasket comprises:

a gasket body that connects the laundry inlet to the tub opening; and a gasket guide that passes through the gasket body from an inner circumferential surface of the gasket body to an outer circumferential surface of the gasket body, the gasket guide protruding radially outward from the outer circumferential surface of the gasket body, and wherein the nozzle spray portion is inserted into the gasket guide.

3. The laundry treating apparatus of claim 2, wherein the nozzle spray portion comprises:

a nozzle pipe that is connected to the circulation flow path portion and defines a nozzle flow path therein; and a discharge pipe that extends from the nozzle pipe and is inserted into the gasket guide, the discharge pipe defining a spray flow path in communication with the nozzle flow path.

4. The laundry treating apparatus of claim 2, wherein the nozzle spray portion comprises:

a nozzle pipe that is connected to the circulation flow path portion and defines a nozzle flow path therein; and a first discharge pipe and a second discharge pipe that respectively extend in parallel to each other from the nozzle pipe, that are spaced apart from each other, and that are inserted into the gasket guide, each of the first and second discharge pipes defining a spray flow path in communication with the nozzle flow path.

5. The laundry treating apparatus of claim 3, wherein the nozzle portion further comprises a pipe protruding portion that extends from an end of the discharge pipe in an extending direction away from the nozzle pipe and is inserted into the gasket, and wherein an outer diameter of the pipe protruding portion increases or decreases along the extending direction.

6. The laundry treating apparatus of claim 1, wherein the circulation flow path portion comprises:

a supply pipe connected to the pump;

a branch connector connected to the supply pipe and configured to divide water supplied from the supply pipe; and branch flow paths connected to the branch connector and configured to guide the water divided by the branch connector to first and second sides of the tub opening, and wherein the nozzle portion is one of a plurality of nozzle portions that are connected to the branch flow paths, the plurality of nozzle portions being disposed at the first and second sides of the tub opening, respectively.

7. The laundry treating apparatus of claim 6, wherein the branch connector comprises:

a water supply pipe connected to the supply pipe;

drain pipes that extend from the water supply pipe in different directions from each other and are coupled to the branch flow paths; and a connector coupling portion that extends from the supply pipe or the water supply pipe and is coupled to the tub.

8. The laundry treating apparatus of claim 7, wherein the tub further comprises a connector boss that protrudes toward the connector coupling portion and is coupled to the connector coupling portion.

9. The laundry treating apparatus of claim 1, wherein the circulation flow path portion is configured to branch the water moved by the pump to the first and second sides of the tub opening.

10. The laundry treating apparatus of claim 9, wherein the each of the first and second nozzle coupling portions comprises:

a first coupling portion that extends from the nozzle spray portion; and a second coupling portion that extends from the first coupling portion, wherein the first coupling portion of the first nozzle coupling portion defines the upper surface of the first nozzle coupling portion and is coupled to the tub, and wherein the second coupling portion of the second nozzle coupling portion defines the lower surface of the second nozzle coupling portion and is coupled to the tub.

11. The laundry treating apparatus of claim 10, wherein the each of the first and second nozzle coupling portions further comprises an extension coupling portion that connects the first coupling portion to the second coupling portion, and wherein the extension coupling portion defines a stepped portion between the first coupling portion and the second coupling portion such that the first coupling portion and the second coupling portion are spaced apart from a surface of the tub by different distances from each other.

12. The laundry treating apparatus of claim 11, wherein the tub further comprises:

a first nozzle boss that protrudes from the first side of the tub opening and is coupled to the first nozzle coupling portion, the first nozzle boss being spaced apart from a bottom surface of the cabinet by a first distance; and a second nozzle boss that protrudes from the second side of the tub opening and is coupled to the second nozzle coupling portion, the second nozzle boss being spaced apart from the bottom surface of the cabinet by a second distance different from the first distance.

13. The laundry treating apparatus of claim 12, wherein the first coupling portion of the first nozzle coupling portion defines:

a first coupling guide configured to guide coupling of the nozzle spray portion with the gasket at the first side of the tub opening; and a first coupling hole coupled to the first nozzle boss at the first side of the tub opening, and wherein the second coupling portion of the second nozzle coupling portion defines:

a second coupling guide configured to guide coupling of the nozzle spray portion with the gasket at the second side of the tub opening, and a second coupling hole coupled to the second nozzle boss at the second side of the tub opening.

14. The laundry treating apparatus of claim 1, further comprising a guide tube having a first end coupled to the detergent supply and a second end coupled to the gasket, the guide tube being configured to supply the detergent stored in the detergent supply into the tub.

* * * * *